US010871070B2

(12) United States Patent
Poulsen

(10) Patent No.: US 10,871,070 B2
(45) Date of Patent: Dec. 22, 2020

(54) DRAINING MESH MODULE AND A METHOD OF OPERATING A DRAINING MESH IN A CONSTRUCTION

(71) Applicant: Dolenco Group ApS, Skibby (DK)

(72) Inventor: Johnny René Poulsen, Skibby (DK)

(73) Assignee: Dolenco Group APS, Skibby (DK)

( * ) Notice: Subject to any disclaimer, the term of this patent is extended or adjusted under 35 U.S.C. 154(b) by 0 days.

(21) Appl. No.: 16/469,854

(22) PCT Filed: Dec. 15, 2017

(86) PCT No.: PCT/DK2017/050433
§ 371 (c)(1),
(2) Date: Jun. 14, 2019

(87) PCT Pub. No.: WO2018/108223
PCT Pub. Date: Jun. 21, 2018

(65) Prior Publication Data

US 2019/0338641 A1 Nov. 7, 2019

(30) Foreign Application Priority Data

Dec. 15, 2016 (DK) ..... 2016 70995
Jun. 29, 2017 (DK) ..... 2017 70516

(51) Int. Cl.
*E21D 11/38* (2006.01)
*E21F 16/02* (2006.01)
*E02D 31/02* (2006.01)

(52) U.S. Cl.
CPC ..... *E21D 11/38* (2013.01); *E21F 16/02* (2013.01); *E02D 31/02* (2013.01)

(58) Field of Classification Search
CPC ..... E21D 11/38; E21D 31/02; E21F 16/02
See application file for complete search history.

(56) References Cited

U.S. PATENT DOCUMENTS 3,888,087 A * 6/1975 Bergsland ..... E02D 31/02 405/36
4,027,903 A 6/1977 Hannover
(Continued)

FOREIGN PATENT DOCUMENTS

CN 205370642 U 7/2016
EP 0738825 A1 10/1996
(Continued)

OTHER PUBLICATIONS

PCT International Search Report issued in corresponding PCT Application No. PCT/DK2017/050433, dated Apr. 24, 2018, pp. 1-3.
(Continued)

*Primary Examiner* — Benjamin F Fiorello
(74) *Attorney, Agent, or Firm* — Murtha Cullina LLP

(57) ABSTRACT

A draining mesh module for building into a construction, such as a tunnel wall, to provide draining channels in said construction, includes at least one semi pipe of a flexible material. The draining mesh module has a longitudinal direction and a cross direction extending crosswise to the longitudinal direction. The semi pipe constitutes a part of a channel extending from one longitudinal end to an opposite longitudinal end of the draining mesh module, and that the longitudinal ends of the draining mesh module comprise attachment means for interconnecting longitudinal ends of two adjacent draining mesh modules, whereby a channel in one of those two draining mesh modules is connected to a channel in the other of those two draining mesh modules.

19 Claims, 5 Drawing Sheets

(56) References Cited

U.S. PATENT DOCUMENTS

| | | | | |
|---|---|---|---|---|
| 4,395,381 | A | 7/1983 | Costes | |
| 4,574,541 | A * | 3/1986 | Raidt | E02D 31/02 52/169.5 |
| 4,840,515 | A * | 6/1989 | Freese | E02B 11/005 405/36 |
| 6,662,516 | B2 * | 12/2003 | Vandehey | E04B 1/7604 52/309.5 |
| 6,691,472 | B2 * | 2/2004 | Hubert | E02D 31/02 405/107 |
| 10,344,470 | B2 * | 7/2019 | Golding, Jr. | B32B 5/26 |
| 2003/0200708 | A1 * | 10/2003 | Parker | E02B 11/00 52/169.5 |
| 2009/0282762 | A1 * | 11/2009 | Iske | E21D 11/381 52/302.1 |
| 2016/0061034 | A1 | 3/2016 | Jonsson | |

FOREIGN PATENT DOCUMENTS

| | | | |
|---|---|---|---|
| EP | 1035300 | A1 | 9/2000 |
| EP | 2253761 | A2 | 11/2010 |
| FR | 2839111 | | 10/2003 |
| GB | 1515242 | | 6/1978 |
| GB | 2258480 | A | 2/1993 |
| JP | 2003277164 | A | 10/2003 |
| WO | 9110782 | | 7/1991 |
| WO | 2009005438 | A1 | 1/2009 |
| WO | 2014163538 | A1 | 10/2014 |

OTHER PUBLICATIONS

"Ground-penetrating radar" from Wikipedia, https://en.wikipedia.org/wiki/Ground-penetrating_radar, Dec. 15, 2016, pp. 1-8.

* cited by examiner

DRAINING MESH MODULE AND A METHOD OF OPERATING A DRAINING MESH IN A CONSTRUCTION

FIELD OF THE INVENTION

The present invention relates to a draining mesh module for building into a construction, such as a tunnel wall, to provide draining channels in said construction, comprising at least one semi pipe of a flexible material.

BACKGROUND OF THE INVENTION

A drainage mesh module of the above art is known from W02009/005438A1, which discloses a drainage mesh comprising two sets of parallel channels intersecting each other at acute angles. At some of the intersection an intersection box is provided, which is provided with an access tube extending to the surface of the construction in an installed condition of the drainage mesh. In case of a blockage in a channel of the mesh, an access tube may be used for flushing the mesh to remove the blockage. However, since the channels are interconnected at every intersection, the flushing agent, such as water, may circumvent the blockage rather than flushing it away. Further since only a limited number of access tubes are provided the distance between a blockage and the nearest access tube may be substantial making it difficult to flush away the blockage.

SUMMARY OF THE INVENTION

It is an object of the present invention to provide a drainage mesh module that facilitates provision of draining channels in a construction, such as a tunnel wall, and/or facilitates flushing such draining channels, and to provide a method of operating a drainage mesh.

Having a first aspect the object is obtained in that said draining mesh module has a longitudinal direction and a cross direction extending crosswise to the longitudinal direction, said at least one semi pipe constituting at least a part of a channel extending from one longitudinal end to an opposite longitudinal end of the draining mesh module, and that the longitudinal ends of the draining mesh module comprise attachment means for interconnecting longitudinal ends of two adjacent draining mesh modules, whereby a channel in one of those two draining mesh modules is connected to a channel in the other of those two draining mesh modules. Hereby provision of an extended draining mesh comprising a plurality of draining mesh modules is facilitated.

In an embodiment the draining mesh module comprises a number of channels extending from one longitudinal end to the other longitudinal end, said channels being mutually disconnected between said longitudinal ends of the draining mesh module. This facilitates flushing a blockage since a flushing fluid, such as water, will be less inclined to circumvent the blockage. Alternatively, one or more of the channels is/are connected to another channel, respectively.

In a further embodiment said channels are interconnected at the longitudinal ends of the draining mesh module by cross channels. Hereby water may still be drained and damming of water be limited, if a channel is blocked. In other embodiments, no cross channels are present.

In a further embodiment at least a first of said cross channels is provided by a section of thin walled material, a second of said cross channels being adapted to reach over to seize the material of the first cross channel to interconnect longitudinal ends of two adjacent draining mesh modules.

Hereby the means for interconnecting adjacent modules are provided in a simple and effective manner because the connection of the two adjacent draining mesh modules is provided for over substantially the entire width of the draining mesh modules.

In an embodiment the attachment means for interconnecting longitudinal ends of two adjacent draining mesh modules are snap-locking means. When the means for interconnecting adjacent modules are provided by the second of the cross channels being adapted to reach over to seize the material of the first cross channel, the second of said cross channels may thus be adapted to snap-lock onto the section providing the first of said cross channels. Hereby is obtained that the adjacent modules are more securely held together during installation, the installation operation thereby being facilitated.

In a further or alternative embodiment, a flat section is present adjacent to the second of the cross channels for fixing to the construction. The fixing may e.g. be obtained by driving a nail or the like through the flat section and into an intermediate surface of the construction on which the draining mesh modules is being positioned and fixed for installation.

In an embodiment at least two adjacent channels are extending from one longitudinal end to an opposite longitudinal end of the draining mesh module said two adjacent channels extending in a wave like manner and in a mutual 180° phase displacement whereby the two adjacent channels are interconnected at junctions where troughs and crests of the respective waves meet. Hereby is further obtained that water dammed due to blockage of one channel may be drained through the second channel of a pair.

In a further embodiment a cross-sectional area of the junctions is approximately twice a cross-sectional area of the channels. This ensures an even flow through different parts of the draining mesh module.

In a further embodiment a plurality of said at least two adjacent channels is provided, said channels comprising a plurality of waves. Hereby is obtained that the draining mesh module provides a draining mesh structure for an area of a substantial size thus facilitating providing a widespread draining mesh structure in a construction by combining a number of draining mesh modules. In an embodiment five of said at least two adjacent channels are provided and said channels respectively comprises three waves, larger or smaller numbers may be used depending on an intended size of the draining mesh modules in their longitudinal and cross directions considering facilitation of installation, transport, storage, etc. Further another number than two might be used for the adjacent channels that are interconnected at junctions where troughs and crests of the respective waves meet.

As used herein semi pipe means a pipe which is open at one side leaving the material of the pipe with e.g. a U-shaped, a C-shaped or a semi-circular cross-section.

The walls of the semi pipes are in an embodiment plain i.e. uncorrugated thereby avoiding spaces where debris might gather. Alternatively, the walls may be corrugated, especially to provide improved flexibility.

The flexible material should allow the draining mesh module to bend to at least generally follow a surface onto which the draining mesh module is mounted for installation while the material should be sufficiently robust to prevent the semi pipe from collapsing when covered e.g. with shotcrete during installation.

As used herein a draining mesh is to be understood as a system of channels leading from a high level, such as the ceiling or top of a tunnel to a low level such as near the floor of such tunnel whereby several channels may be connected to allow liquid, such as water drained by means of the draining mesh, to flow horizontally to a certain degree which may not be substantial.

In an embodiment, within an area covered overall by the draining mesh module, the draining mesh per se covers between 70% and 90%, preferably between 75% and 85% of said area, while the remaining parts of the area are void to ensure on one hand an effective draining function and on the other hand a good adherence between layers of construction material, such as shotcrete on either side of the draining mesh module.

Having a second aspect, this is obtained in that said material is degradable. Building a draining mesh into a construction using draining mesh modules according to the invention provides instantaneously draining channels in the construction. However, the present inventor has realized that once the construction is finished and set the draining mesh modules are as such not required any longer. Using a degradable material entails that after installation of a drainage mesh comprising channels provided by the draining mesh modules, the material of the modules degrades to be flushed away by water drained by the mesh and accordingly, once the construction need to be renovated by tearing down and rebuilding parts of the construction, draining mesh material, such as plastics, need not be separated from the main construction material, such as concrete to be disposed of separately, which entails that the solution according to the invention is more environment-friendly and economic than the prior art. Further, the cross section of the channels is slightly enlarged when the degraded material of the draining mesh modules is flushed away, which contributes to facilitating removal by flushing of future blockage e.g. due to debris emanating from the construction.

The degradable material may e.g. be a biologically degradable material, such as polylactic acid or another biologically degradable plastics material. Alternatively, the degradable material may e.g. be alkali degradable to be decomposed by the alkaline environment provided by concrete, such as shotcrete, in which the draining mesh module is embedded when installed, or the degradable material may e.g. be a water soluble material to be dissolved by the water that is drained through the draining mesh.

Having a third aspect, the object is obtained in that said material is translucent or transparent to microwave radiation, especially at the wavelength used by Ground Penetrating Radar (GPR) technique. This facilitates a method of detecting blockage whereby a surface of a construction in which the draining mesh module(s) are embedded is scanned by GPR scanning. According to the result of the scanning a hole may be drilled into the construction at the location of the blockage in order to provide an access for flushing the blocked channel.

Having a fourth aspect, a method of operating a drainage mesh in a construction, such as a tunnel wall, provided by a number of drainage mesh modules, e.g. according to the present invention, comprises scanning, e.g. GPR scanning, a surface of said construction overlying at least a part of the drainage mesh to observe blockages and damming of water in said draining mesh, providing a hole from said surface into a channel of the drainage mesh, and removing one or more said blockages via said hole.

In an embodiment of said fourth aspect, the step of removal of one or more said blockages includes flushing a flushing fluid, such as water, through said hole.

In another embodiment of said fourth aspect, the step of removal of one or more said blockages includes inserting a tool through said hole to mechanically remove one or more said blockages, said tool preferably being so flexible as to allow it to enter said drainage mesh so as to remove one or more said blockages. Flexibility of the tool thus may allow for easier removal of said blockage(s).

In another embodiment of said fourth aspect, the method further comprises the subsequent step of flushing fluid through said drainage mesh and observing, preferably visually, whether said one or more blockages have been removed by observing whether said fluid exits said drainage mesh.

In another embodiment of said fourth aspect, said hole extends at an inclined angle to said drainage mesh. The drainage mesh may extend substantially in a plane, said angle being 10 to 80, 20 to 70, 30 to 60 or 40 to 50 degrees in relation to said plane. This may allow for easier cleaning since a tool for said flushing or mechanical cleaning may be inserted at an inclined angle, allowing for easier access to the spacings of the drainage mesh.

BRIEF DESCRIPTION OF THE FIGURES

In the following the invention will be explained in further detail having reference to the accompanying schematic drawings, in which.

DETAILED DESCRIPTION

Figure 1:
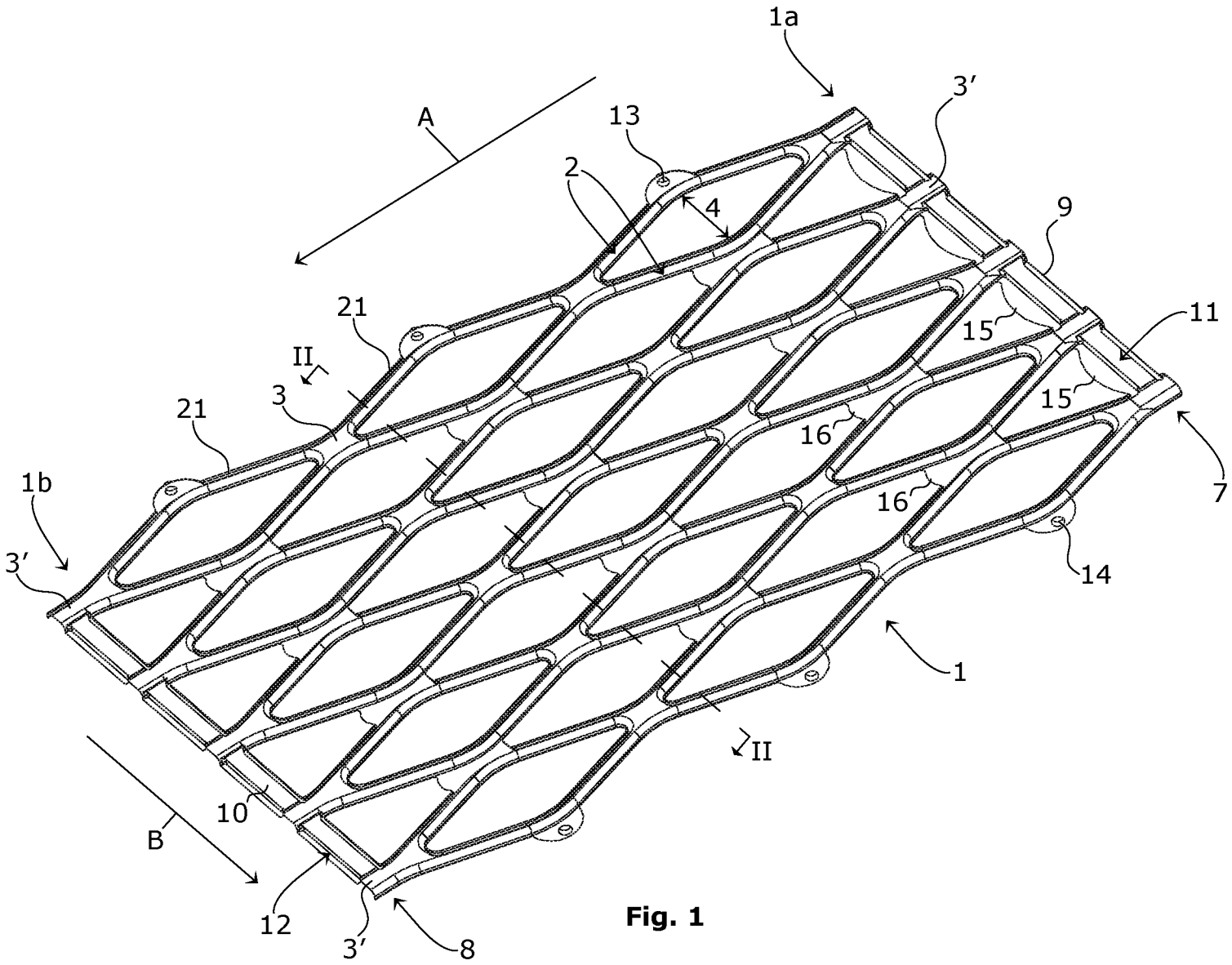
FIG. 1 is a perspective view from an outside of a draining mesh module according to an example of an embodiment of the invention.
Figure 2:
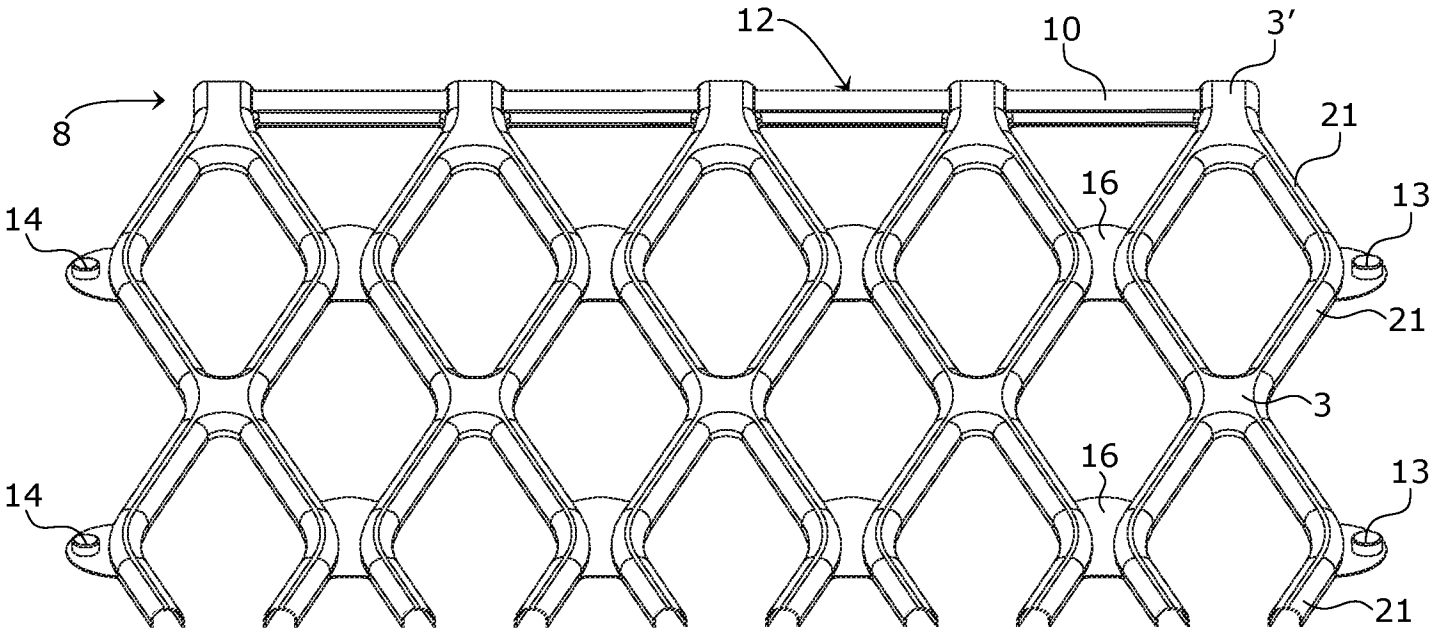
FIG. 2 shows a section along II-II in FIG. 1 seen obliquely from the outside and in a downwards longitudinal direction.

FIG. 1 shows an overview of a draining mesh module 1 comprising of a number of draining channels 2 forming a mesh structure. The draining mesh module 1 is generally an element of a thin walled, flexible material and comprises a plurality of semi pipes 21 providing the draining channels 2. The draining channels 2 are extending in a wave like manner from a first longitudinal end 1*a* to a second longitudinal end 1*b* of the draining mesh module 1. Thus the draining mesh module 1 has an arbitrarily defined longitudinal direction A and a cross direction B extending crosswise to the longitudinal direction A.

In an intended mounted position, the draining channels 2 thus extend downwards in an alternating angle from a vertical direction. The draining channels 2 are in the embodiment shown organized in pairs and the two channels in each pair are mutually displaced by 180° to have regular junctions 3 between the paired draining channels where respective troughs and crests of the waveforms meet. The junctions 3 form common voids allowing drained water from a first draining channel to flow into its paired draining channel and thereby distribute flow. The cross-sectional area of the junctions 3 is approximately twice the cross-sectional area of the channels 2 to ensure an even flow through different parts of the draining mesh module.

The alternating angle of the respective draining channels creates a shape having a width 4 being the largest distance between the two paired draining channels at half way between respective junctions 3.

The draining mesh module 1 comprise five pairs of draining channels 2, the pairs being disconnected from each other between the longitudinal ends 1*a*, 1*b* of the draining mesh module 1.

Figure 3:
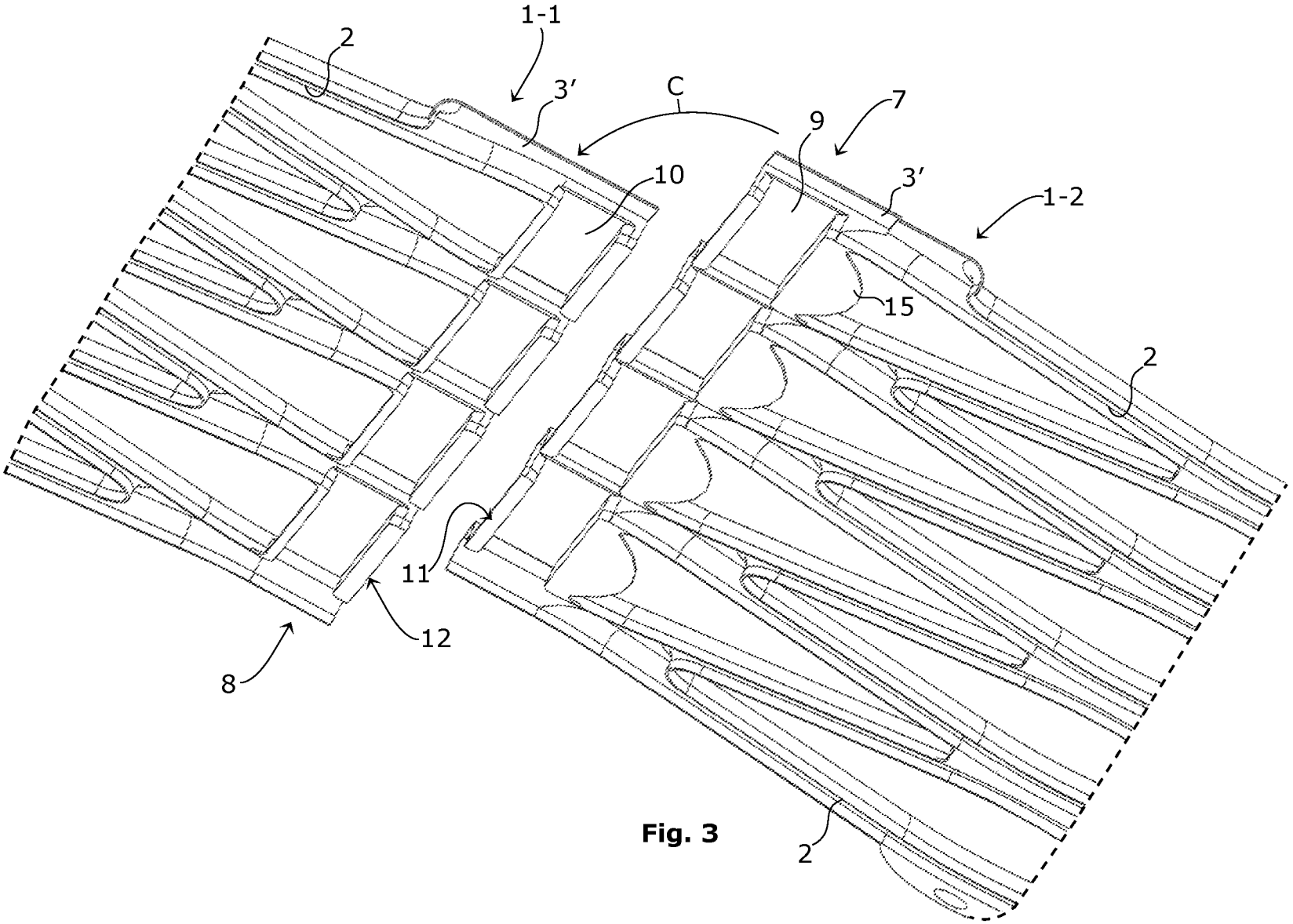
FIG. 3 is an enlarged perspective partial view seen from an inside of adjacent ends of two draining mesh modules.

At the longitudinal ends 1*a*, 1*b* the pairs of channels 2 are mutually connected in that the junctions 3' of a top row 7 and a bottom row 8 are interconnected by cross channels 9, 10. The cross channels 9, 10 are provided by respective sections 11, 12 of the thin walled material and the dimensions of the cross channel 9 at the top row 7 are slightly larger than the dimensions of the cross channel 10 at the bottom row 8 and accordingly the section 11 of one draining mesh module 1-2 is adapted to reach over and seize the section 12 of an adjacent draining mesh module 1-1 as indicated by arrow C in FIG. 3, the cross channel 8 being thereby nested into the cross channel 7. Thus the sections 11 and 12 provide attachment means for interconnecting the longitudinal ends 1*a* and 1*b* of two adjacent draining mesh modules 1-2 and 1-1. The section 11 may even snap-lock onto the section 12 to keep the two draining mesh modules 1-1 and 1-2 together during installation as explained below. The draining mesh module 1 is further equipped with lateral connection means 13, 14 for connecting laterally a series of draining mesh modules 1 as it will be explained below. The lateral connection means comprise left connection means 13 and right connection means 14 both of which are cup-shaped but slightly different of size whereby the right connection means 14 may be nested into the left connection means 13 (or vice versa) and be snap-locked in the nested position.

Finally, the draining mesh module comprises first web sections 15 or flat section at top row 7 of junctions 3 and second web sections 16 or flat section at the junctions 3 intermediate of the top and bottom rows 7, 8.

Figure 4:
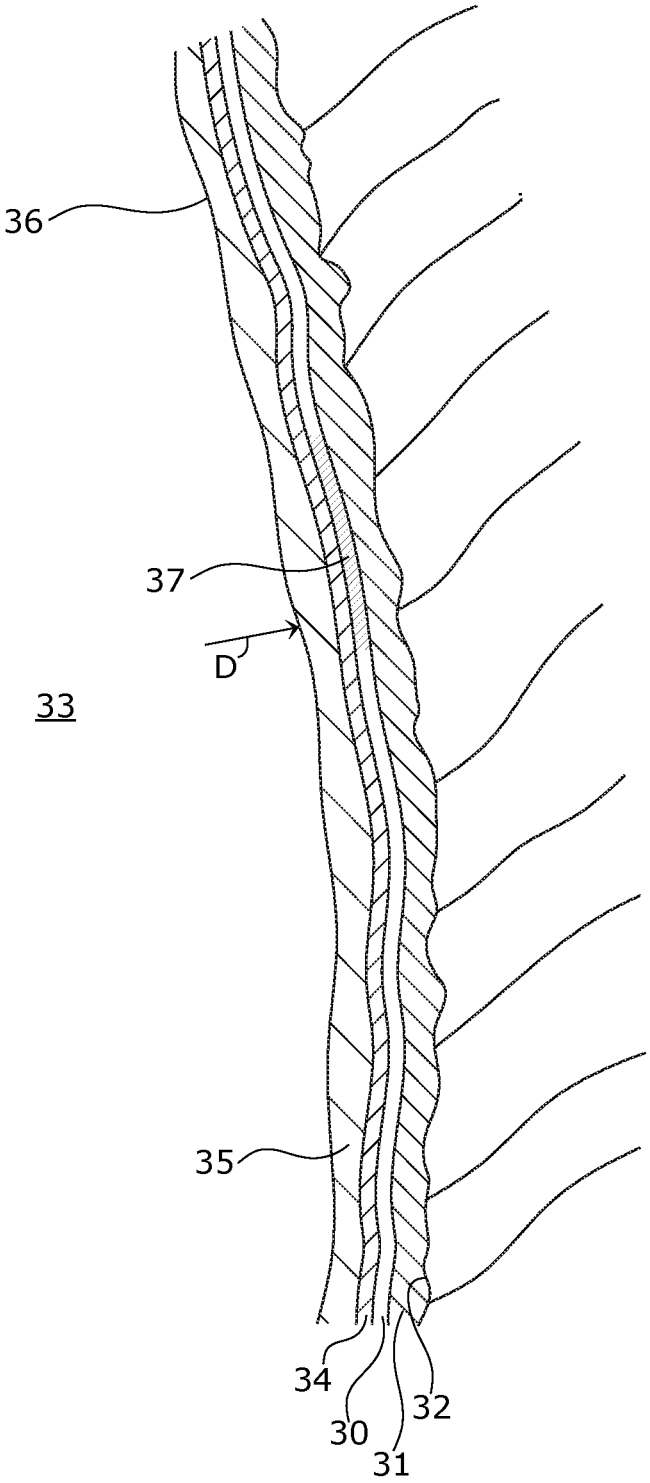
FIG. 4 is a vertical section of a tunnel wall comprising a draining mesh.

Referring to FIG. 4 a draining mesh 30 may be installed in a tunnel wall as follows. A first layer of shotcrete 31 is applied to a rock wall 32 of a tunnel 33. The first layer of shotcrete 31 provides a relatively even surface, compared to the surface of the rock wall 32, as a support for the draining mesh 30. The draining mesh 30 is provided by attaching draining mesh modules 1 to the first layer of shotcrete 31 by positioning draining mesh modules 1 on said first layer of shotcrete 31 with the inside of the draining mesh modules 1 against the first layer of shotcrete 31 and fixing the draining mesh module 1 e.g. by driving nails through the first and second web sections 15 and 16 by means of a nail gun. The draining mesh modules 1 are positioned with their top row 7 upwards and the cross channels 9, 10 substantially horizontal. A number of draining mesh modules 1 may be interconnected before being attached to the first layer of shotcrete 31 nesting together cross channels 9 and 10 as described above and nesting left and right connection means 13, 14 together as also described above, or the draining mesh modules 1 may be connected successively as they are ready for fixing to the first layer of shotcrete 31 in order to secure the correct mutual positioning of adjacent draining mesh modules 1. Especially cross channels 9, 10 should be correctly nested to ensure connection of the channels 2 of one draining mesh module 1-2 with the channels 2 of the adjacent draining mesh module 1-1 below.

Thus, in the embodiment shown (FIG. 3), the five junctions 3' in the bottom row 8 of the first draining mesh module 1-1 are nested into the five junctions 3' og the top row 7 of the second draining mesh module 1-2 when the section 12 is nested into section 11 to provide a united junctions connecting the five paired channels 2 of the first draining mesh module 1-1 respectively with the five paired channels 2 of the second draining mesh module 1-2. Thus sets of paired channels 2 may be provided from the top of the tunnel to the bottom of the tunnel, where the cannels 2 of the lowest draining mesh modules are connected to a drain such as a gutter or the like. At the connections between respective draining mesh modules 1 the nested, and thus combined, cross channels 9, 10 provide for liquid flowing laterally between the different sets of paired channels 2.

Lateral connection of draining mesh modules 1 may be dispensed with since the channels 2 of respective draining mesh modules 1 are not laterally interconnected.

Once the draining mesh modules 1 have been fixed to the first layer of shotcrete 31 by means of nails (or other suited fastening means), a second layer of shotcrete 34 is applied starting with covering the semi pipes 21, junctions 3, and the bottom and top row 8, 7 including the combined cross channels 9, 10 to further secure the draining mesh modules 1 to the first layer of shotcrete 31 and ensure formation of draining channels in the second layer 34 of shotcrete. Subsequently shotcrete is applied to the areas between semi pipes, etc. to provide a complete second layer of shotcrete 34 with a good adherence to the first layer of shotcrete 31. A third layer of shotcrete 35 is subsequently applied. Whereas the first and the second layer of shotcrete are water permeable to allow water seeping from the rock wall 32 to be drained through the draining mesh 30 thus provided, the third layer 35 is water impermeable to force the seeping water into the draining mesh 30.

In an embodiment the second layer of shotcrete 34 may be water impermeable and in such case the third layer of shotcrete may be dispensed with. Such embodiment is e.g. applicable where only small amounts of water are leaking or seeping from the rock wall.

In the embodiment shown the paired draining channels 2 forms generally a diamond like shape allowing water leaking through the rock wall 32 to be efficiently drained. It is preferred that the shaped formed by the paired draining pipes have a width 4 that is smaller than the length between adjacent junctions 3 connecting the two channels 2 of a pair of channels, but the shape could be any elongated shape such as an ellipse shape or a hexagonal shape. The width 4 is in an embodiment 10 to 20 cm.

In the embodiment shown each channel 2 in the draining mesh module 1 forms three waves and five pairs of channels 2 are present in the draining mesh module 1. The draining mesh module 1 is in an embodiment made of a flexible thin walled material and thus the inside of the draining mesh module 1 is generally a negative of the outside of the draining mesh module 1. This allows the draining mesh modules 1 to be stacked for transport, at least the semi pipes 21, and the junctions 3 and 3' of a draining mesh module 1 being at least partially nested into the semi pipes 21, and the junctions 3 and 3' of adjacent draining mesh modules 1 above and below in the stack. The draining mesh module 1 preferably has overall dimensions in the longitudinal direction A and the cross direction B that are suited for transport e.g. for the draining mesh module to have dimensions similar to a pallet, e.g. a EUR-pallet.

A draining mesh like the draining mesh 30 risk blockage of channels e.g. due to debris emanating from the rock wall 32 and accordingly flushing of certain sections of certain channels may be needed once in a while. Accordingly, an inner surface 36 of the tunnel wall may be scanned at intervals of e.g. 1 to 5 years using any known scanning technique suited to observe material such as water or solid material in the normally hollow channels 2. Such scanning may e.g. be a GPR scanning technique. Having observed a blockage 37 a hole may be drilled as indicated by arrow D into the channel 2, see FIG. 4, at the blockage to provide an opening for injecting flushing liquid, such as water into the draining mesh 30 to remove the blockage.

Figure 5:
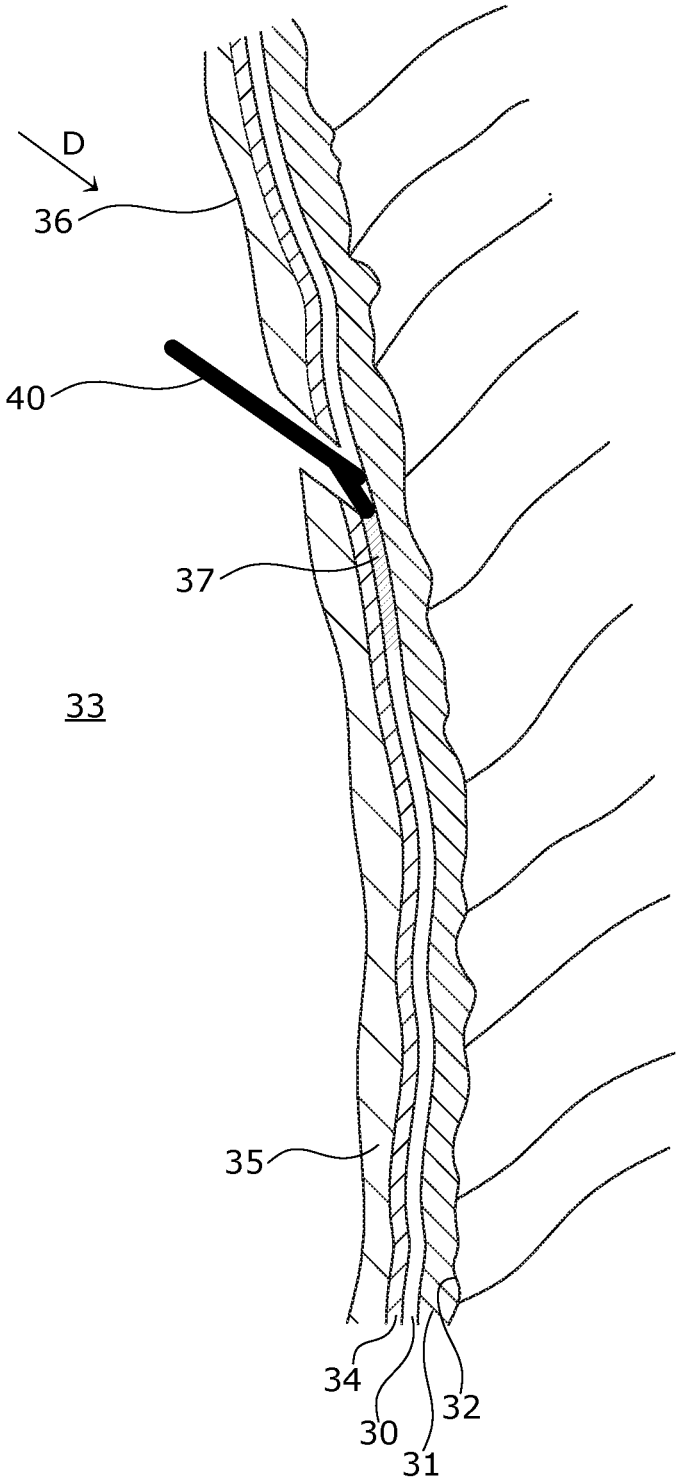
FIG. 5 is a vertical section of a tunnel wall comprising a draining mesh and illustrates insertion of a cleaning tool.

As an alternative, as shown in FIG. 5, blockage may be removed by inserting a tod-shaped tool 40 through said hole to mechanically remove the blockage 37. The tool shown is so flexible as to allow it to enter the drainage mesh 30 so as to remove the blockage 37. Flexibility of the tool 40 allows for easier removal of the blockage.

Subsequent to removal of the blockage, fluid is flushed through the drainage mesh 30 and it is observed visually whether the blockage 37 has been removed by observing whether the fluid is able to exit from the drainage mesh 30.

As shown in FIG. 5, the hole extends at an inclined angle, specifically about 45 degrees, to the drainage mesh 30. The drainage mesh 30 extends substantially in a plane; however, with a small curvature corresponding to that of the tunnel wall, said angle being 10 to 80, 20 to 70, 30 to 60 or 40 to 50 degrees in relation to said plane. This allows for easier cleaning since the tool 40 may be inserted at a similarly inclined angle, allowing for easier access to the spacings of the drainage mesh. Subsequent to removal of the blockage 37, the hole is sealed using a quick-drying mortar.

In an embodiment the material of the draining mesh modules 1 is degradable, especially biologically degradable, such as polylactic acid. In this case the draining mesh modules may be degraded and flushed away by water seeping from the rock wall leaving draining mesh walls of shotcrete, and the draining mesh modules will not influence the scanning.

In an embodiment in which the material of the draining mesh modules is not degradable a material may be chosen which is translucent or transparent to microwave radiation, especially at the wavelength used by Ground Penetrating Radar technique (GPR) in order not to impede GPR scanning.

What is claimed is:

1. A draining mesh module for building into a construction to provide draining channels in said construction, comprising at least one semi pipe of a flexible material, wherein said draining mesh module has a longitudinal direction and a cross direction extending crosswise to the longitudinal direction, said at least one semi pipe constituting at least a part of a channel extending from one longitudinal end to an opposite longitudinal end of the draining mesh module, and the longitudinal ends of the draining mesh module is provided for interconnecting longitudinal ends of two adjacent draining mesh modules, whereby a channel in one of those two draining mesh modules is connected to a channel in the other of those two draining mesh modules, said draining mesh module comprising a number of channels extending from one longitudinal end to the other longitudinal end, at least two of said channels being mutually disconnected between said longitudinal ends of the draining mesh module.

2. A draining mesh module according to claim 1, wherein several of said channels are interconnected at the longitudinal ends of the draining mesh module by cross channels.

3. A draining mesh module according to claim 2, wherein at least a first of said cross channels is provided by a section of material, a second of said cross channels being adapted to reach over to seize the material of the first cross channel to interconnect longitudinal ends of two adjacent draining mesh modules.

4. A drainage mesh module according to claim 1, wherein attachment means for interconnecting longitudinal ends of two adjacent draining mesh modules are snap-locking means.

5. A drainage mesh module according to claim 3, said draining mesh module comprising a flat section adjacent the second of the cross channels for fixing to the construction.

6. A draining mesh module according to claim 1, wherein at least two adjacent channels are extending from one longitudinal end to an opposite longitudinal end of the draining mesh module said two adjacent channels extending in a wave like manner and in a mutual 180° phase displacement whereby the two adjacent channels are interconnected at junctions where troughs and crests of the respective waves meet.

7. A draining mesh module according to claim 6, wherein a cross-sectional area of the junctions is approximately twice a cross-sectional area of the channels.

8. A draining mesh module for building into a construction to provide draining channels in said construction, comprising at least one semi pipe of a flexible material, wherein said draining mesh module has a longitudinal direction and a cross direction extending crosswise to the longitudinal direction said at least one semi pipe constituting at least a part of a channel extending from one longitudinal end to an opposite longitudinal end of the draining mesh module, and the longitudinal ends of the draining mesh module is provided for interconnecting longitudinal ends of two adjacent draining mesh modules, whereby a channel in one of those two draining mesh modules is connected to a channel in the other of those two draining mesh modules, wherein said material is degradable.

9. A drainage mesh module for building into a construction to provide draining channels in said construction, comprising at least one semi pipe of a flexible material, wherein said draining mesh module has a longitudinal direction and a cross direction extending crosswise to the longitudinal direction, said at least one semi pipe constituting at least a part of a channel extending from one longitudinal end to an opposite longitudinal end of the draining mesh module, and the longitudinal ends of the draining mesh module is provided for interconnecting longitudinal ends of two adjacent draining modules, whereby a channel in one of those two draining mesh modules is connected to a channel in the other of those two draining mesh modules, wherein said material is translucent or transparent to microwave radiation.

10. A draining mesh module according to claim 9, wherein said material is translucent or transparent to microwave radiation at a wavelength used by Ground Penetrating Radar technique (GPR).

11. A method of operating a drainage mesh in a construction, provided by a number of draining mesh modules for building into a construction to provide draining channels in said construction, comprising at least one semi pipe of a flexible material, wherein said draining mesh module has a longitudinal direction and a cross direction extending crosswise to the longitudinal direction, said at least one semi pipe constituting at least a part of a channel extending from one longitudinal end to an opposite longitudinal end of the draining mesh module, and the longitudinal ends of the draining mesh module is provided for interconnecting longitudinal ends of two adjacent draining mesh modules, whereby a channel in one of those two draining mesh modules is connected to a channel in the other of those two draining mesh modules, said method comprising scanning a surface of said construction overlying at least a part of the drainage mesh to observe blockages in said draining mesh, subsequently providing a hole from said surface into a channel of the drainage mesh, and removing one or more said blockages via said hole.

12. A method according to claim 11, wherein the step of removal of one or more said blockages includes flushing a flushing fluid through said hole.

13. A method according to claim 11, wherein the step of removal of one or more said blockages includes inserting a tool through said hole to mechanically remove one or more said blockages.

14. A method according to claim 11, further comprising the step of flushing fluid through said drainage mesh and observing whether said one or more blockages have been removed by observing whether said fluid exits said drainage mesh.

15. A method according to claim 11, wherein said hole extends at an inclined angle to said drainage mesh.

16. A draining mesh module for building into a construction to provide draining channels in said construction, comprising at least one semi pipe of a flexible material, wherein said draining mesh module has a longitudinal direction and a cross direction extending crosswise to the longitudinal direction, said at least one semi pipe constituting at least a part of a channel extending from one longitudinal end to an opposite longitudinal end of the draining mesh module, and the longitudinal ends of the draining mesh module comprise attachment means for interconnecting longitudinal ends of two adjacent draining mesh modules, whereby a channel in one of those two draining mesh modules is connected to a channel in the other of those two draining mesh modules.

17. A draining mesh module according to claim 16, said draining mesh module comprising a number of channels extending from one longitudinal end to the other longitudinal end, at least two of said channels being mutually disconnected between said longitudinal ends of the draining mesh module.

18. A draining mesh module according to claim 16, wherein at least two adjacent channels are extending from one longitudinal end to an opposite longitudinal end of the draining mesh module said two adjacent channels extending in a wave like manner and in a mutual 180° phase displacement whereby the two adjacent channels are interconnected at junctions where troughs and crests of the respective waves meet.

19. A draining mesh module according to claim 18, wherein a cross-sectional area of the junctions is approximately twice a cross-sectional area of the channels.

* * * * *